US005222597A

United States Patent [19]

Bluthardt et al.

[11] Patent Number: 5,222,597

[45] Date of Patent: Jun. 29, 1993

[54] GOLF BALL CARRIER

[76] Inventors: Edward A. Bluthardt; Robert E. Bluthardt, both of 6612 Lakepointe, Utica, Mich. 48089; Jeffrey L. Goins, Sr., 55605 Card Rd., New Haven, Mich. 48048

[21] Appl. No.: 829,360

[22] Filed: Jan. 23, 1992

[51] Int. Cl.[5] ..... B65D 85/00

[52] U.S. Cl. ..... 206/315.9; 211/14; 229/93

[58] Field of Search ..... 206/315.9, 315.3, 315.2, 206/315.1; 211/14, 15; 229/93

[56] References Cited

U.S. PATENT DOCUMENTS

| | | | |
|---|---|---|---|
| 811,556 | 2/1906 | Gray | 229/93 |
| 1,625,856 | 4/1927 | Judd | 211/14 |
| 1,754,495 | 4/1930 | Anderson | 206/315.9 |
| 3,756,299 | 9/1973 | Simmons et al. | 206/315.9 |
| 4,020,948 | 5/1977 | Won | 206/315.9 |
| 5,040,675 | 8/1991 | Cleveland et al. | 211/15 X |
| 5,044,495 | 9/1991 | Wyslotsky | 206/315.9 |

*Primary Examiner*—Steven N. Meyers
*Assistant Examiner*—Jacob K. Ackon, Jr.
*Attorney, Agent, or Firm*—John R. Benefiel

[57] ABSTRACT

A golf ball carrier is disclosed comprised of an elongated inner carrier sleeve open at either end and slotted for its full length, configured to receive a number of golf balls inserted one at a time into either end and grip the same. The inner carrier sleeve is substantially completely received into an elongated approximately equal length carrier sleeve closed at one end. The golf balls can be removed by being pulled through the slot, after the carrier sleeve is withdrawn from the casing tube sufficiently to expose the ball to be removed.

2 Claims, 1 Drawing Sheet

GOLF BALL CARRIER

BACKGROUND OF THE INVENTION

The present invention concerns golf ball carrier devices. It has heretofore been proposed to provide tubular carriers to be inserted in a golf bag along with the golf clubs. Such carriers for the most part involve rigid tubes closed at one end, with the balls loaded and unloaded at one end.

See U.S. Pat. No. 1,754,495 for an example of such a design. This approach requires the tube to be completely withdrawn and tipped to remove a ball.

More elaborate designs have utilized a spring loaded piston to present each ball at an opening at the top of the tube. See U.S. Pat. No. 2,950,748 for an example of this improvement.

The addition of a spring dispensing mechanism adds to the cost and slows the loading process. In addition, neither design allows convenient removal of intermediate balls in the stack, nor inspection of these balls while in the carrier.

U.S. Pat. No. 3,756,299 describes a slotted tube which allows intermediate balls contained in a carrier tube to be withdrawn. This design requires individual partitions to be adhesively mounted within the tube in order that the tube have sufficient rigidity for handling. This requires separate loading of each compartment through the slots, slowing the loading process. The compartmented construction increases the cost of manufacture and makes removal of a ball more difficult, particularly the balls next to a partition, as the partition makes resilient opening of the slot more difficult.

Accordingly, it is the object of the present invention to provide a tubular golf ball holder which is inexpensive to manufacture and convenient in use.

SUMMARY OF THE INVENTION

This object is achieved by a two piece carrier, with an inner extruded plastic carrier tube of generally round cross sectional shape which has a single slot extending for the full length along one side and has a generally elliptical or oblong relaxed shape. The slot is of sufficient width to allow easy removal of balls loaded therein from either open end of the carrier tube. The carrier tube has a generally elliptical or oblong cross sectional shape to loosely grip inserted balls, so that the loaded balls will not escape from the open ended carrier tube.

An outer, round casing tube also of extruded plastic of about the same length but closed at one end is slidably fit over the inner carrier tube to substantially completely enclose the same, which casing tube cooperates with the balls to deform the carrier tube into a more nearly round shape, the outer casing tube thereby frictionally gripping the carrier tube to be retained in place.

The tube assembly is quite rigid having more than adequate rigidity to withstand normal handling. Easy and convenient removal of any ball in the carrier is enabled by withdrawing the carrier tube from the casing to expose the desired ball, which is then withdrawn through the slot.

No moving parts or extensive assembly or construction steps are required such that manufacturing costs are minimal.

DETAILED DESCRIPTION

Figure 1:
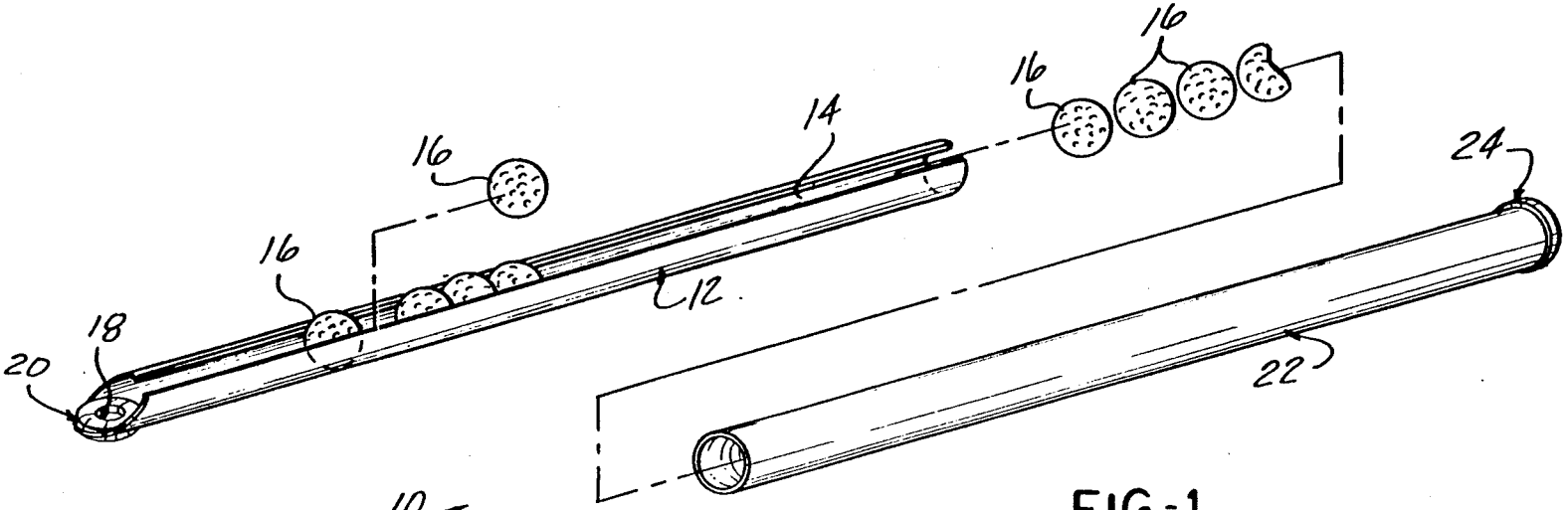
FIG. 1 is an exploded perspective view of the ball carrier according to the invention with several balls loaded therein.
Figure 3:
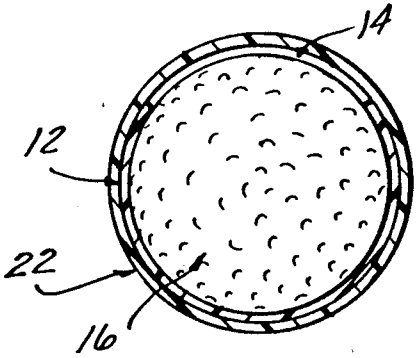
FIG. 3 is a transverse sectional view of the inner carrier tube with the outer casing tube assembled thereover showing a golf ball loaded thereinto.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the Drawings, the golf ball carrier 10 includes a pair of interfit extruded plastic tubes, including an inner elongated generally rounded in section carrier tube 12 which has a single slot 14 extending along one side for its full length. The carrier tube 12 is open at both ends to allow insertion one at a time of a series of golf balls 16. The shape and diameter of the carrier tube is such as to be able to slidably receive golf balls 16 insert therein. The top end may be formed with a lifting-hanger eye 18, with a rubber grommet provided for easier handling.

An outer, elongated, round in section casing tube 22 of the same approximate length is closed at the bottom with a cap 24. Casing tube 22 is sized to be slidable over the carrier tube 12, with a same friction fit to insure secure retention.

Figure 2:
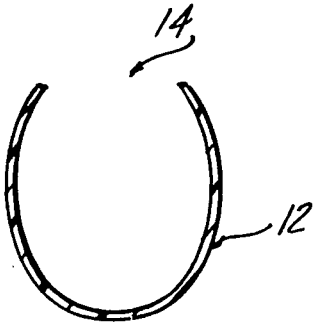
FIG. 2 is a transverse sectional view of the inner carrier tube.

As shown in FIG. 2, the carrier sleeve 12 is shaped somewhat elliptically in cross section, i.e., oblong cross sectional shape having a narrowed width along a major axis, with the slot 14 located at one end of the major axis of the ellipse as shown, so that the walls of the carrier sleeve 12 are adapted to grip golf balls 16 inserted therein.

Upon sliding the casing tube 22 over the carrier tube 12, the carrier tube 12 is forced over the golf balls 16 into a substantially round shape.

This sets up a proper frictional fitting of the casing tube 22 within the carrier tube 12.

The carrier tube 12, as noted, grips the balls 16 so as to be able to be handled fully loaded without danger of the golf balls spilling out.

The slot 14 is sufficiently wide to enable any individual golf ball to be pulled out through the slot 14 as indicated in FIG. 1. At the same time, removal of any golf ball 16 in the stack is easily accomplished by pulling the same out of the stack through the slot 14.

It can be appreciated that the carrier 10 is constructed of simple components, able to be manufactured at low cost, yet provides very convenient storage and access to a relatively large number of golf balls.

We claim:

1. A golf ball carrier comprised of:

an inner elongated carrier tube open at both ends and having a single slot extending along its entire length, said carrier tube having a generally rounded cross sectional shape such as to be able to receive a number of golf balls inserted thereinto, and with a stiffness so as to loosely grip a golf ball by the walls of said carrier tube upon insertion therein;

a casing tube closed at one end and approximately the same length as said carrier tube, said carrier tube slidably received in said casing tube to be substantially entirely enclosed therein, said slot in said carrier tube being of sufficient width to enable withdrawal of a golf ball held in said carrier tube by being grasped with the fingers, reaching through said slot and pulled out through said slot;

said carrier tube oblong shaped in cross section, with a narrowed width along a major axis thereof prior to being inserted in said casing tube, with said slot being located at one end of said major axis; and said casing tube round in cross sectional shape to cause said carrying tube to be deformed from said oblong cross sectional shape into a round cross sectional shape when inserted into said casing tube.

2. The carrier according to claim 1 wherein said carrier and casing tubes are constructed of extruded plastic.

* * * * *